US008376640B2

(12) United States Patent
Ogawa

(10) Patent No.: US 8,376,640 B2
(45) Date of Patent: Feb. 19, 2013

(54) PRINTING MEDIA FEEDING APPARATUS, PRINTING APPARATUS PROVIDED WITH THE FEEDING APPARATUS, PRINTING MEDIA FEEDING SPEED CONTROL METHOD AND COMPUTER PROGRAM

(75) Inventor: Kaoru Ogawa, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 11/203,395

(22) Filed: Aug. 12, 2005

(65) Prior Publication Data

US 2006/0039736 A1 Feb. 23, 2006

(30) Foreign Application Priority Data

Aug. 23, 2004 (JP) ..... P2004-242797

(51) Int. Cl.
*B41J 11/00* (2006.01)
*B41J 11/42* (2006.01)
*B41J 2/32* (2006.01)

(52) U.S. Cl. ..... 400/582; 400/279; 400/578

(58) Field of Classification Search ..... 400/582, 400/615.2, 279, 229, 61, 578; 358/1.9; 347/172, 347/16, 211, 14
See application file for complete search history.

(56) References Cited

U.S. PATENT DOCUMENTS 4,449,052 A * 5/1984 Krieg ..... 250/568
4,459,050 A * 7/1984 Goldberg et al. ..... 400/279
4,836,697 A * 6/1989 Plotnick et al. ..... 400/615.2
5,068,818 A * 11/1991 Uramoto et al. ..... 708/445
5,123,331 A * 6/1992 Hirai ..... 91/363 A
5,547,295 A * 8/1996 Kanemitsu ..... 400/279
5,611,629 A * 3/1997 Paranjpe ..... 400/82
5,696,853 A * 12/1997 Kawana et al. ..... 382/299
5,735,604 A * 4/1998 Ewals et al. ..... 374/134
5,867,544 A * 2/1999 Taniguchi ..... 375/376
5,941,359 A * 8/1999 Naito ..... 192/146
6,169,966 B1 * 1/2001 Miura et al. ..... 702/142
6,334,181 B1 * 12/2001 Boutaud et al. ..... 712/38

(Continued)

FOREIGN PATENT DOCUMENTS

EP 0 741 044 A2 * 6/1996
JP 61-266086 11/1986

(Continued)

OTHER PUBLICATIONS

Merriam Webster's Collegiate Dictionary, Tenth Edition, 1997, p. 170, left column.*

*Primary Examiner* — Daniel J Colilla
*Assistant Examiner* — Marissa Ferguson Samreth
(74) *Attorney, Agent, or Firm* — Robert J. Depke

(57) ABSTRACT

The present invention prevents density irregularity from appearing in a print result and to thereby improve image quality by controlling a motor so that the rotational speed of a drive shaft that feeds printing media is constant. The present invention provides a printing media feeding apparatus including a feeding section that includes a motor, a drive transmission mechanism which transmits a driving force of the motor, and a drive shaft to which the driving force is transmitted by the drive transmission mechanism. The drive shaft is rotated to feed the printing medium. A detection section is provided having at least a portion secured to the drive shaft and the detection section determines the rotational speed of the drive shaft and a controller controls the motor based on an input from the detection section so that the rotational speed the of the drive shaft is constant.

13 Claims, 16 Drawing Sheets

U.S. PATENT DOCUMENTS

| | | | | |
|---|---|---|---|---|
| 6,538,409 | B2 * | 3/2003 | Takemoto | 318/560 |
| 6,715,947 | B1 * | 4/2004 | Cornelius et al. | 400/322 |
| 6,771,919 | B2 * | 8/2004 | Koide | 399/167 |
| 6,789,869 | B2 * | 9/2004 | Takeishi | 347/16 |
| 6,864,802 | B2 * | 3/2005 | Smith et al. | 340/870.07 |
| 6,876,467 | B1 * | 4/2005 | Yamaguchi | 358/1.9 |
| 7,004,654 | B2 * | 2/2006 | Shibata et al. | 400/615.2 |
| 2004/0075708 | A1 * | 4/2004 | Arakawa | 347/19 |
| 2005/0035989 | A1 * | 2/2005 | Arakawa et al. | 347/16 |

FOREIGN PATENT DOCUMENTS

| | | |
|---|---|---|
| JP | 63-296976 | 12/1988 |
| JP | 05-169708 | 7/1993 |
| JP | 11-334160 | 12/1999 |
| JP | 2000-023492 | 1/2000 |
| JP | 2001-239686 | 9/2001 |
| JP | 2003-081076 | 3/2003 |

* cited by examiner

PRINTING MEDIA FEEDING APPARATUS, PRINTING APPARATUS PROVIDED WITH THE FEEDING APPARATUS, PRINTING MEDIA FEEDING SPEED CONTROL METHOD AND COMPUTER PROGRAM

CROSS REFERENCES TO RELATED APPLICATIONS

The present invention contains subject matter related to Japanese Patent Application JP 2004-242797 filed in Japanese Patent Office on Aug. 23, 2004, the entire contents of which being incorporated herein by reference.

BACKGROUND OF THE INVENTION

1. Field of the Invention

The present invention relates to a printing media feeding apparatus, a printing apparatus provided with the feeding apparatus, a printing media feeding speed control method, and a computer program.

2. Description of the Related Art

In related art a thermal printer with a thermal head has a thermal head in which a plurality of heat elements are linearly arranged and controls power distribution to the heat elements depending on the tone level to heat a heat-sensitive recording layer, thereby printing an image on printing media.

In such a thermal printer, color density depends on the energy applied to the printing media. That is, to obtain deep color, the heating value of the heat elements is increased; to obtain light color, the heating value thereof is reduced.

The energy to be applied to the printing media is increased when the feeding speed of the printing media is low. In this case, the obtained color may become deeper than a desired level. On the other hand, the energy to be applied to the printing media is reduced when the feeding speed of the printing media is high, with the result that the obtained color may become lighter than a desired level.

As shown in FIG. 1, speed irregularity of the printing media appears as density irregularity in an image printed on the printing media, the density irregularity being formed by a plurality of lines running in the direction perpendicular to the feeding direction of the printing media. In FIG. 1, an area 101 is a low-density part, and area 102 is a high-density part. It is therefore demanded in the thermal printer that the speed irregularity in the feeding operation of the printing media be eliminated.

In general, the printing media feeding apparatus uses a stepping motor as a drive source to rotate a capstan of the final stage through a drive transmission mechanism such as a pulley, an endless belt, and a gear. The capstan feeds the printing media while holding the printing media together with a roller provided opposite thereto. Since a means for directly feeding the printing media is the capstan, the rotational speed of the capstan needs to be constant in order to feed the printing media at a constant speed.

However, it is difficult to make the rotational speed of the capstan constant, since it depends on the mechanical accuracy of the drive transmission mechanism. For example, the rotational speed of the capstan comes under the influence of the rotational accuracy of the pulley, the rotational accuracy of the capstan itself, and the like. However, even if the drive transmission mechanism has been mechanically assembled with high accuracy, it is still difficult to make the feeding speed of the printing media constant and eliminate the density irregularity.

As prior art documents related to a technique of eliminating the density irregularity, the following patent documents are known: Jpn. Pat. Appln. Laid-Open Publication Nos. H11-334160, H5-169708, 2001-239686, and S63-296976.

SUMMARY OF THE INVENTION

The present invention has been made to solve the above problem, and it is desirable to provide a printing media feeding apparatus capable of controlling a motor so that the rotational speed of a drive shaft that allows the printing media to run become constant to prevent the density irregularity from appearing in the printing result to thereby increase image quality, a printing apparatus provided with the feeding apparatus, a printing media feeding speed control method, and a computer program.

According to the present invention, there is provided a printing media feeding apparatus comprising: a feeding means that includes a motor, a drive transmission mechanism which transmits a driving force of the motor, and a drive shaft to which the driving force is transmitted by the drive transmission mechanism, the drive shaft being rotated to feed the printing media; a detection means that is provided in the drive shaft and detects the rotational speed of the drive shaft; and a control means for controlling the motor, the control means controlling the motor based on an input from the detection means so that the rotational speed of the drive shaft becomes constant.

According to the present invention, there is provided a printing apparatus comprising: a print head that prints visual data on printing media; a feeding means that includes a motor, a drive transmission mechanism which transmits a driving force of the motor, and a drive shaft to which the driving force is transmitted by the drive transmission mechanism, the drive shaft being rotated to feed the printing media; a detection means that is provided in the drive shaft and detects the rotational speed of the drive shaft; and a control means for controlling the motor, the control means controlling the motor based on an input from the detection means so that the rotational speed of the drive shaft becomes constant.

According to the present invention, there is provided a printing media feeding speed control method that rotates a drive shaft through a drive transmission mechanism transmitting a driving force of a motor to feed printing media, comprising the steps of: detecting the rotational speed of the drive shaft; and controlling the rotation number of the motor based on the detected rotational speed so that the rotational speed of the drive shaft becomes constant.

According to the present invention, there is provided a computer program used for a printing media feeding speed control method that rotates a drive shaft through a drive transmission mechanism transmitting a driving force of a motor to feed printing media, comprising the steps of: detecting the rotational speed of the drive shaft; and controlling the rotation number of the motor based on the detected rotational speed so that the rotational speed of the drive shaft becomes constant.

The present invention having the configuration as described above detects the rotational speed of the drive shaft that feeds the printing media and controls, based on the detected rotational speed, the rotation number of the motor so that the rotational speed of the drive shaft becomes constant, thereby making the feeding speed of the printing media constant. As a result, in a printed image, the density irregularity caused due to irregularity of the feeding speed of the printing media can be reduced or eliminated.

BRIEF DESCRIPTION OF THE DRAWINGS

FIG. 14A is a view showing spectrum strength (irregularity strength) for each frequency obtained by applying Fast Fourier Transform to the density data same as FIG. 9, and FIG. 14B is a view obtained by applying Fast Fourier Transform to clock number which is a speed fluctuation component of the capstan 14*d* in the feeding direction and plotting frequency on the abscissa and spectrum strength (irregularity strength) on the ordinate;

FIG. 15A shows the case before feedback control, and FIG. 15B shows the case after feedback control; FIG. 16A shows the case before feedback control, and FIG. 16B shows the case after feedback control.

DETAILED DESCRIPTION OF THE PREFERRED EMBODIMENTS

A printer apparatus according to the present invention will be described below with reference to the accompanying drawings.

Figure 2:
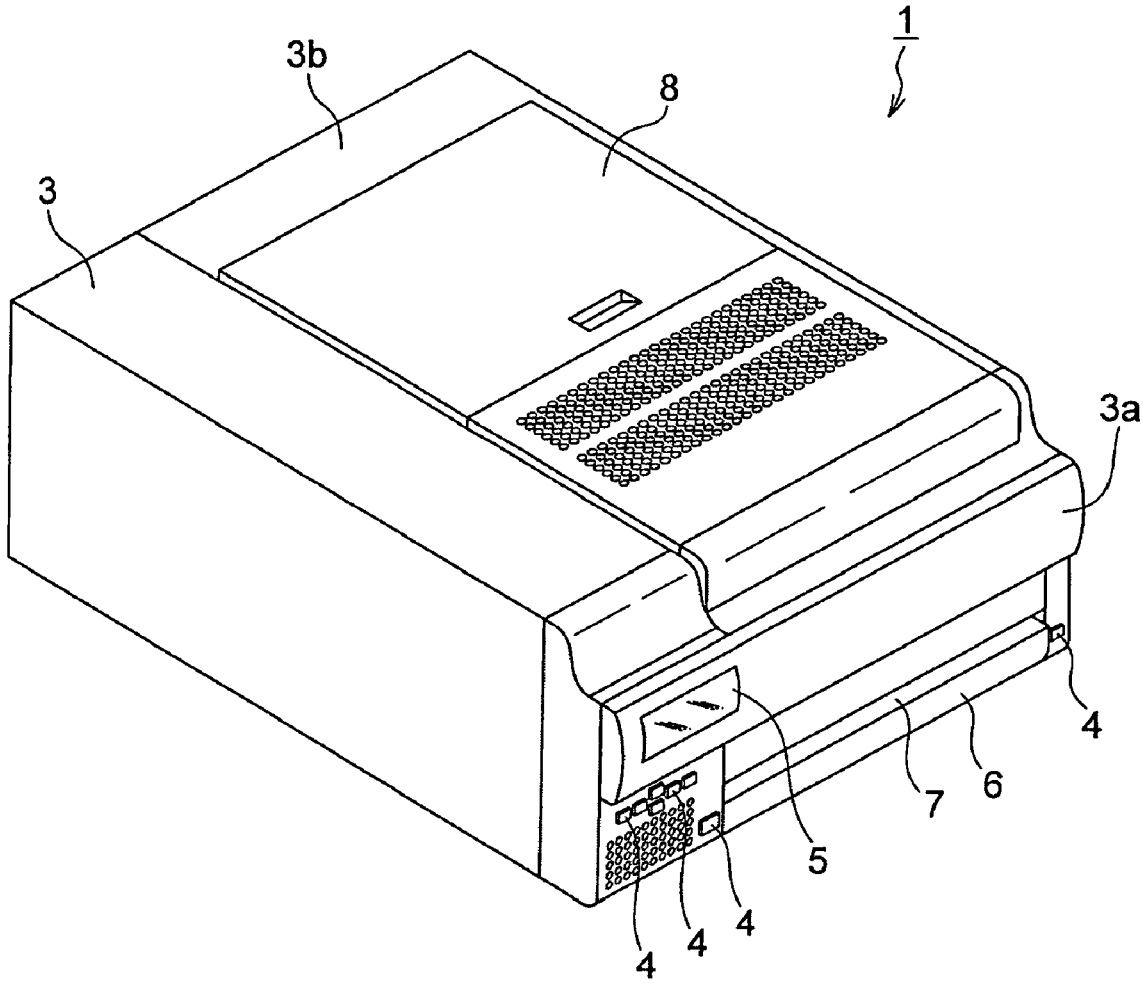
FIG. 2 is a perspective view of a printer apparatus according to the present invention, the printer apparatus being placed flat.
Figure 3:
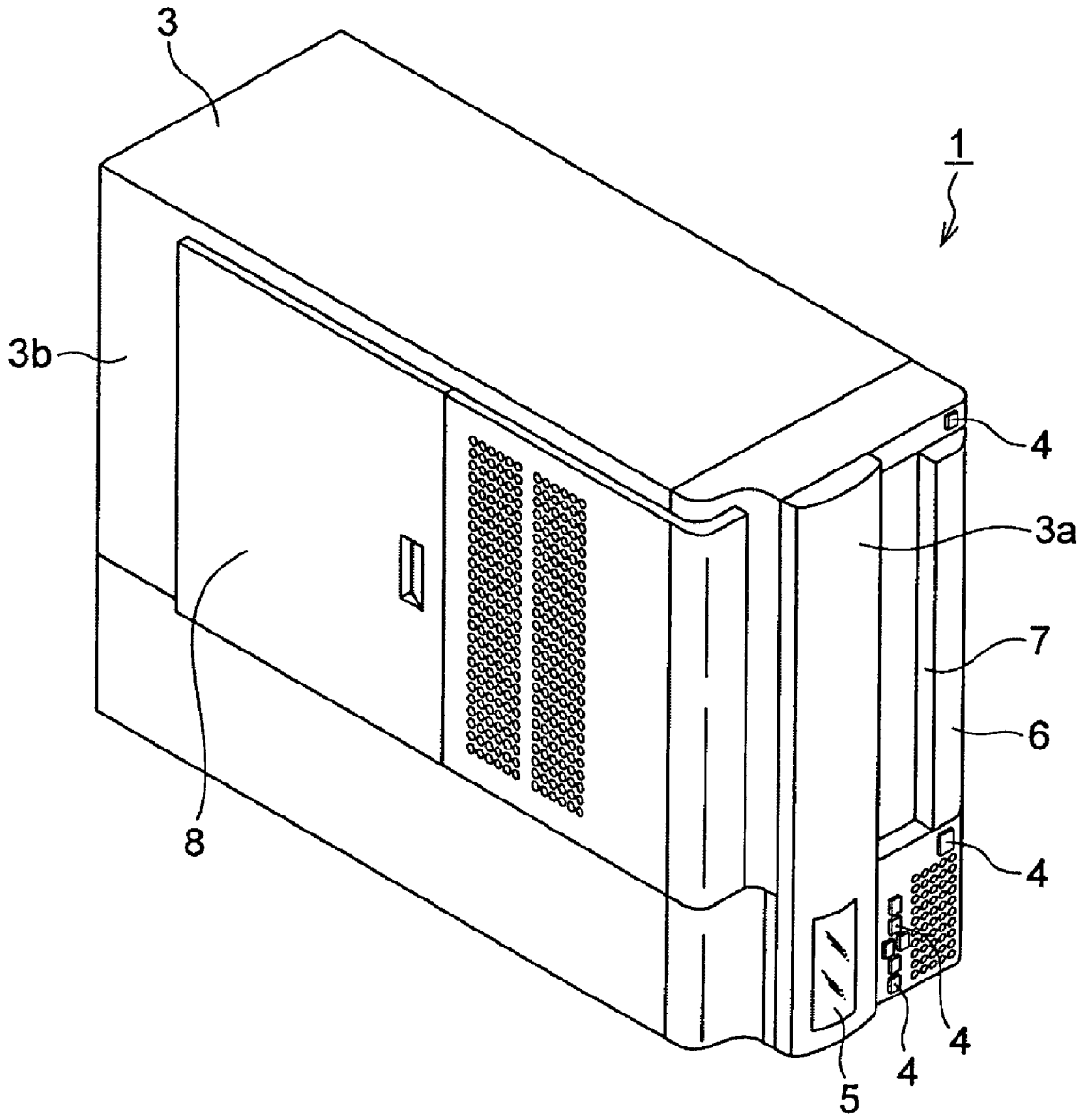
FIG. 3 is a perspective view of the printer apparatus, which is placed upright.
Figure 4:
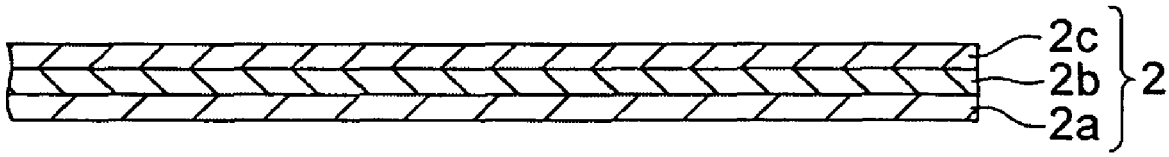
FIG. 4 is a cross-sectional view of a print sheet.

As shown in FIGS. 2 and 3, a printer apparatus 1 according to the present invention uses, as a print sheet, a print film on which CT (Computerized Tomography) image data and the like taken in a hospital is printed. The printer apparatus 1 prints the image data with thermal transfer technology. A print sheet 2 used in the printer apparatus 1 is, as shown in FIG. 4, obtained by laminating a heat-sensitive layer 2*b* on a resin sheet 2*a* and further laminating a protection layer 2*c* on the heat-sensitive layer 2*b*. The print sheet 2 thus obtained has rigidity higher than that of fine paper or coated paper and has elasticity.

As shown in FIGS. 2 and 3, the printer apparatus 1 has a rectangular casing 3. The front face 3*a* of the casing 3 serves as an operation face. Various operation buttons 4 such as a power button, a reset button, and a paper eject button, as well as a display section 5 constituted by an LCD (Liquid Crystal Display) that indicates an operation state and the like are arranged on the front face 3*a*. Further arranged on the front face 3*a* of the casing 3 are a detachable housing tray 6 in which the print sheets 2 are stacked and an ejection port 7 from which the print sheet 2 is ejected. The housing tray 6 and ejection port 7 are arranged adjacently to each other.

An outer lid 8 for opening/closing an opening of the casing 3 is provided on one side face 3*b* of the casing 3. A positioning block for positioning the print sheet 2 being fed and the like are provided in the interior of the casing 3 that is covered by the outer lid 8. When paper jam occurs, the outer lid 8 is opened to apply maintenance.

The printer apparatus 1 can be placed flat, as shown in FIG. 2, such that the sheet surface of the print sheet 2 is horizontally set, as well as, can be placed upright, as shown in FIG. 3, such that the sheet surface of the print sheet 2 is vertically set. That is, a user can select whether the printer apparatus 1 is to be placed flat or upright depending on the install location, thereby increasing usability.

Figure 5:
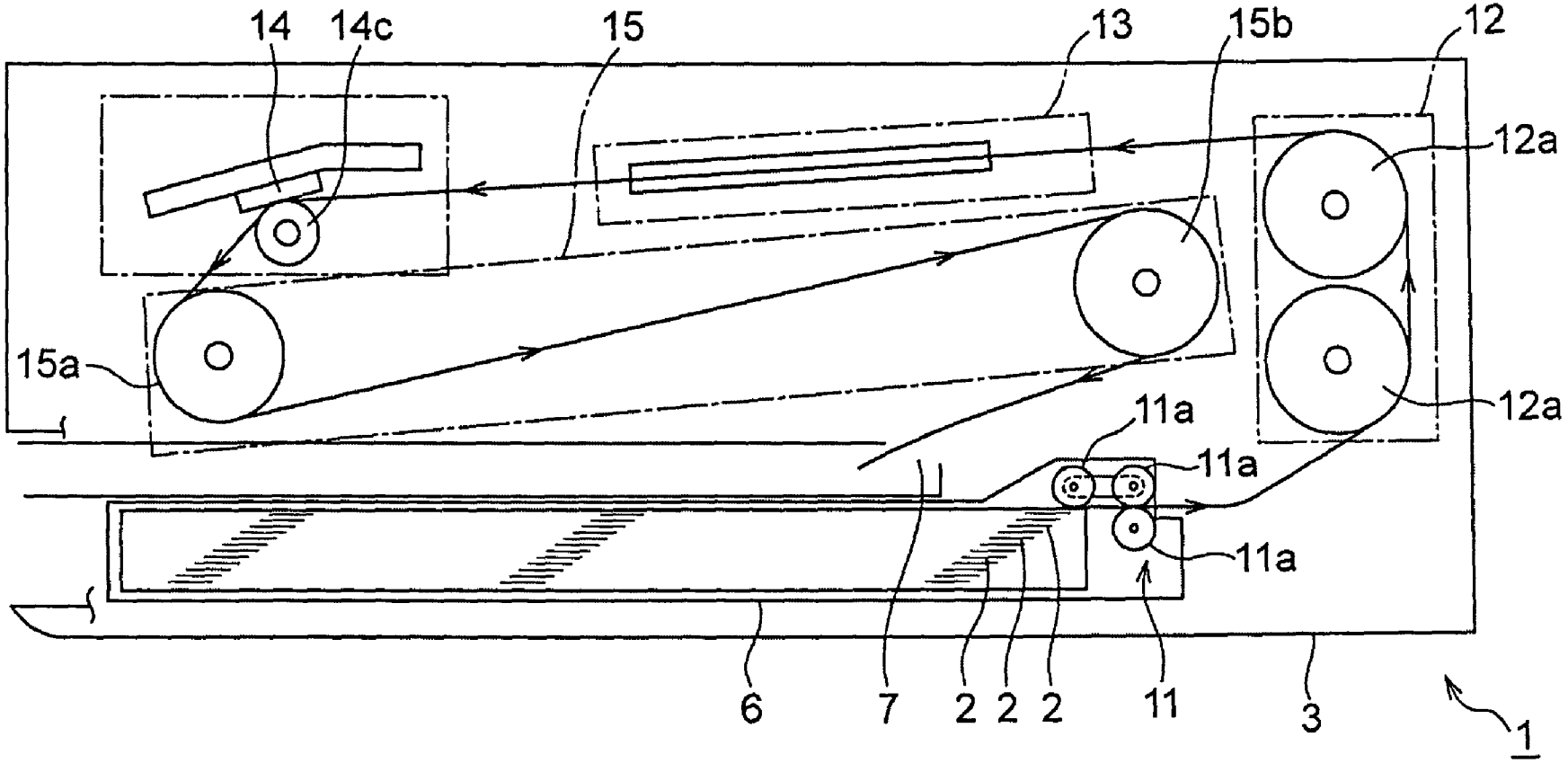
FIG. 5 is a view showing an internal configuration of the printer apparatus.

The internal configuration of the printer apparatus 1 will be described with reference to FIG. 5. The printer apparatus 1 uses a pick-up block 11 constituted by a plurality of rollers 11*a* and the like for picking up the stacked print sheet 2 from the housing tray 6 housed in the casing 3 to pick up one sheet and then uses a plurality of feeding rollers 12*a* that constitute a feeding block 12 to feed the picked up print sheet 2.

After positioning the print sheet 2 with the positioning block 13 before printing, the printer apparatus 1 perform printing on the print sheet 2 with a printing block 14 based on print data, reverses the printed print sheet 2 with a reverse roller 15*a* that constitutes a feeding block 15, further reverses the print sheet 2 with a reverse roller 15*b* that constitutes the feeding block 15, and ejects the print sheet 2 from the ejection port 7.

Figure 6:
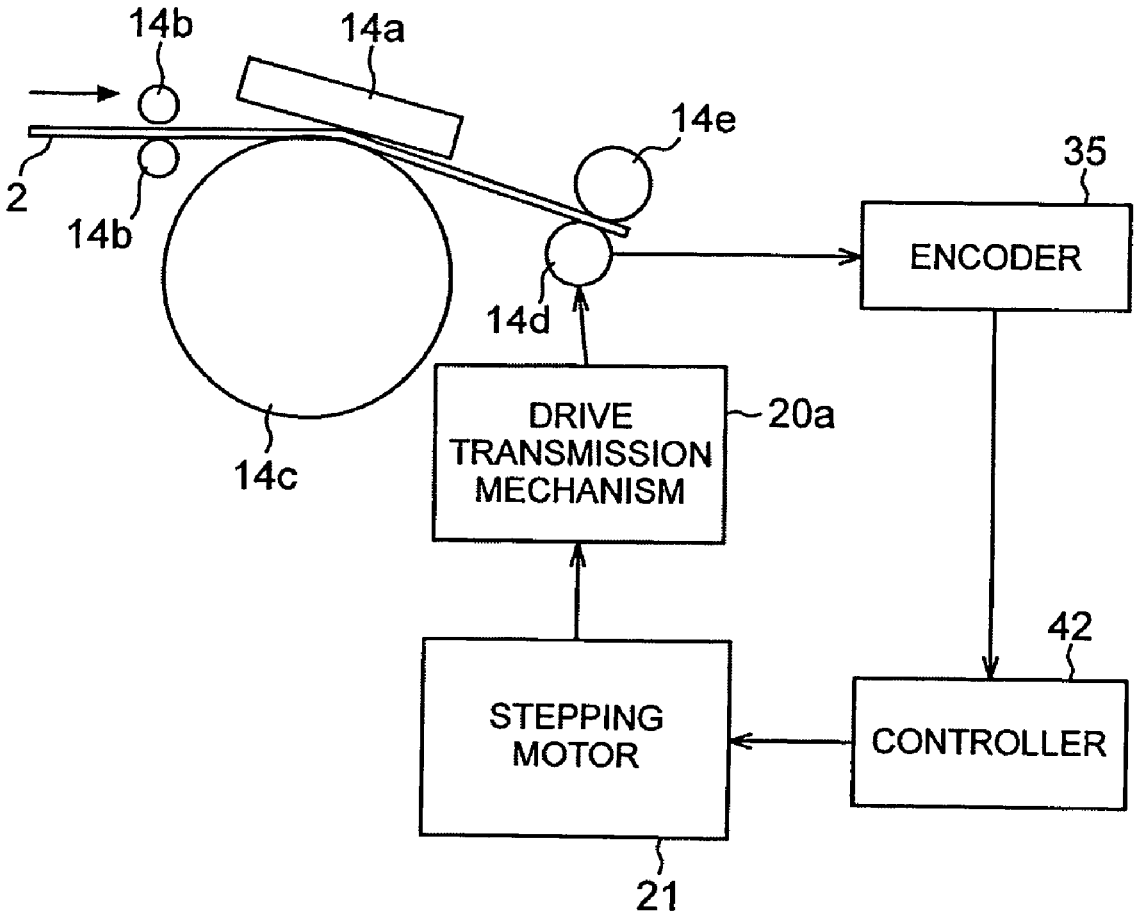
FIG. 6 is a view showing a configuration of a printing block of the printer apparatus.

As shown in FIG. 6, in the printing block 14 used here, a print head 14*a* such as a thermal head for heating the print sheet 2, in which a plurality of heat elements are arranged in the direction perpendicular to the feeding direction of the print sheet 2 is supported by a head support member. A platen roller 14*c* is disposed opposite to the print head 14*a*. The print sheet 2, which is guided by guide rollers 14*b* and held between a capstan 14*d* and roller 14*e*, is fed by the rotation of the capstan 14*d*.

In the printing block 14, the print head 14*a* and platen roller 14*c* sandwich the print sheet 2, and the print head 14*a* heats the print sheet 2 to thereby forming an image on the print sheet 2. In this printer apparatus 1, the platen roller 14*c* is not in a driven state at the printing time. The platen roller is rotated in the feeding direction of the print sheet 2 when the print sheet 2 is fed without being printed.

Figure 7:
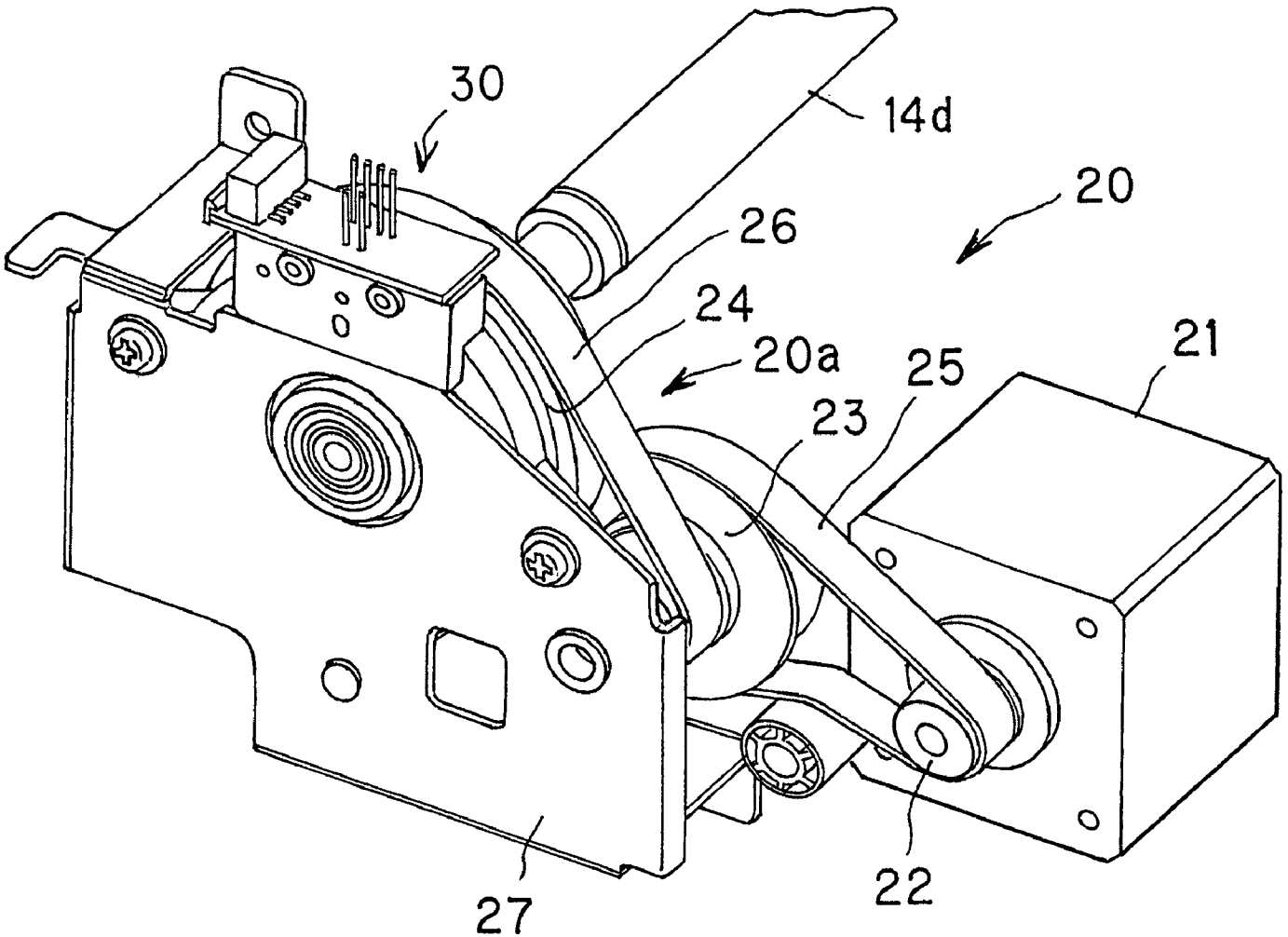
FIG. 7 is a perspective view showing the drive mechanism of a capstan.

A drive mechanism 20 of the capstan 14*d* will be described with reference to FIG. 7. A stepping motor 21 is used as a drive source of the drive mechanism 20. A driving force of the stepping motor 21 is transmitted through a drive transmission mechanism 20*a* to the capstan 14*d*. The drive transmission mechanism 20*a* includes first to third pulleys 22, 23, and 24.

The first pulley 22 is fitted to the drive shaft of the stepping motor 21 and is coupled to the second pulley 23 through a first endless belt 25. The second pulley 23 is coupled to the third pulley 24 to which the capstan 14*d* is fitted through a second endless belt 26.

The first to third pulleys 22 to 24 are rotatably fitted to spindles provided on a base 27. When the first pulley 22 is rotated, the driving force of the stepping motor 21 is transmitted to the second pulley 23 through the first endless belt 25 and further transmitted to the third pulley 24 through the second endless belt 26, thereby causing the capstan 14*d* integrally fitted to the third pulley 24 to be rotated.

Figure 8:
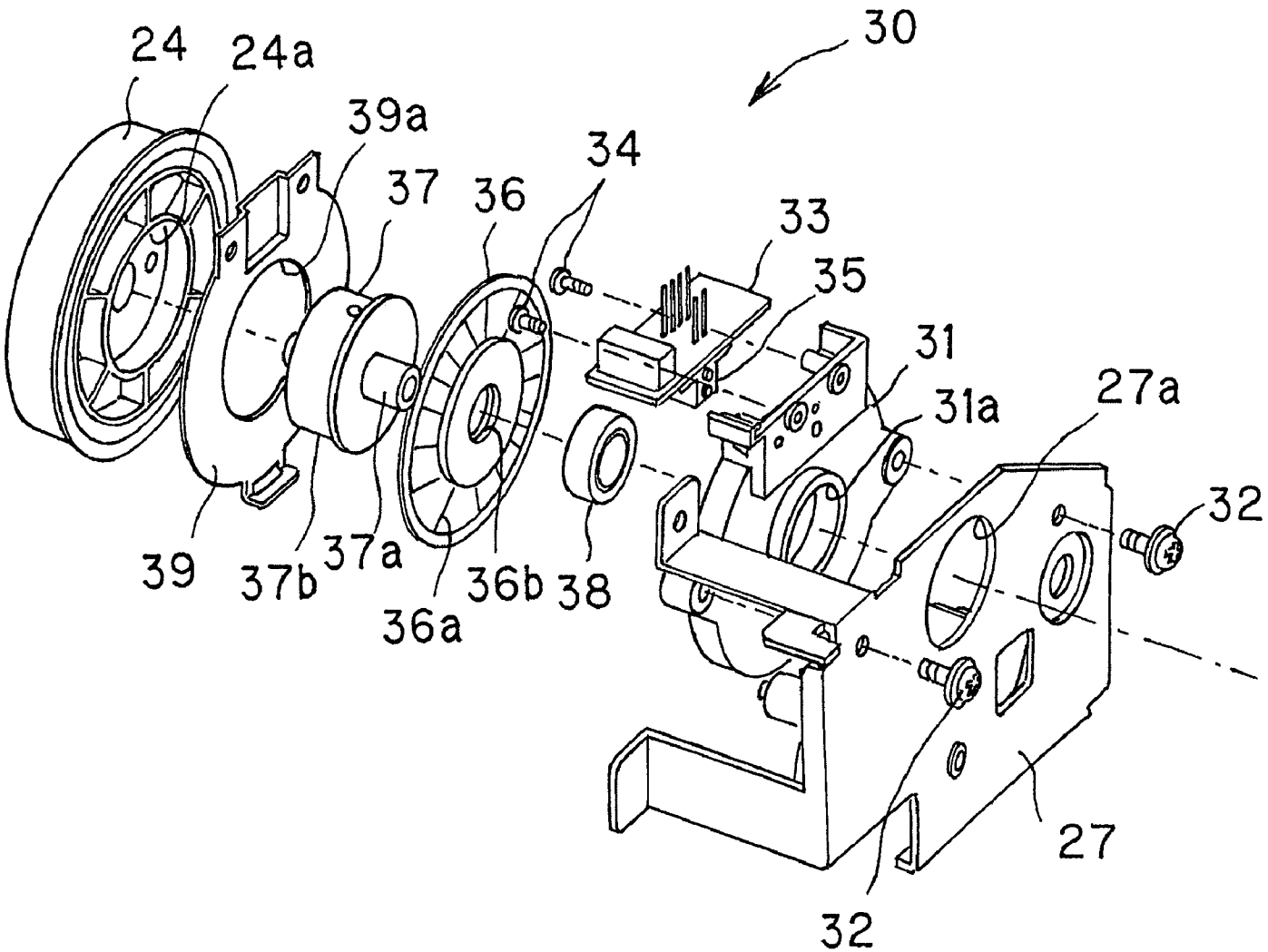
FIG. 8 is an exploded perspective view showing a detection mechanism that detects the rotation of the capstan.

A detection mechanism 30 for detecting the rotational speed of the capstan 14*d* is provided in the third pulley 24 to which the capstan 14*d* is integrally fitted. In the detection mechanism 30, as shown in FIG. 8, a sensor substrate 33 is fixed to a bracket 31 by screws 34, and the bracket is fixed to the base 27 by screws 32.

The sensor substrate 33 has an encoder 35 constituted by a light emitter and light receiver disposed opposite to each other. An encoder disc 36 is provided between the light emitter and light receiver constituting the encoder 35. The encoder disc 36 has a plurality of slits 36*a* formed radially and is rotated together with the capstan 14*d*. In order to perform the speed control of the capstan 14*d* (to be described later) correctly, the number of the slits 36*a* is determined so that two or more pulse signals can be output from the encoder 35 while one line that constitutes an image is being printed.

The encoder 35 detects the rotation of the capstan 14*d* by detecting a light that has emitted from the light emitter and passed through the slits 36*a* with the light receiver. The encoder 35 outputs, for example, 2000 pulses during one rotation of the capstan 14*d* and outputs 3.6 pulses while one line is printed (for example, 6.25 ms/one line).

The detection mechanism 30 further has an attachment member 37 to which the capstan 14*d* is press-fitted. Provided in the center of the attachment member 37 is a sleeve 37*a*, to which the capstan 14*d* is press-fitted. The sleeve 37*a* is inserted through a center hole 36*b* of the encoder disc 36 and further inserted through a bearing 38 so that the attachment member 37 to be integrally fitted to the capstan 14*d* can smoothly be rotated relative to the bracket 31 fixed to the base 27.

The bearing 38 is press-fitted to a through hole 31*a* of the bracket 31 that has been fixed to the base 27. A cover 39 is fixed to the bracket 31 by screws or the like in such a manner to house the encoder disc 36 fixed to the attachment member 37 and bearing 38 in the space between the cover 39 and bracket 31. A main body 37*b* of the attachment member 37 projects from a through hole 39*a* of the cover 39 and is press-fitted to an inner concave-portion 24*a* of the third pulley 24 of the drive transmission mechanism 20*a*.

The capstan 14*d* is press-fitted to the attachment member 37 to be integrally fitted to the third pulley 24, and thereby the capstan 14*d* is rotated relative to the bracket 31 that has been fixed to the base 27. The encoder 35 detects the rotation of the capstan 14*d* by detecting a light that has passed through the slits 36*a* of the encoder disc 36 which is rotated integrally with the capstan 14*d* through the attachment member 37. The capstan 14*d* goes into the feeding path of the print sheet 2 through a through hole 27*a* of the base 27 to feed the print sheet 2 in corporation with the roller 14*e*.

Figure 1:
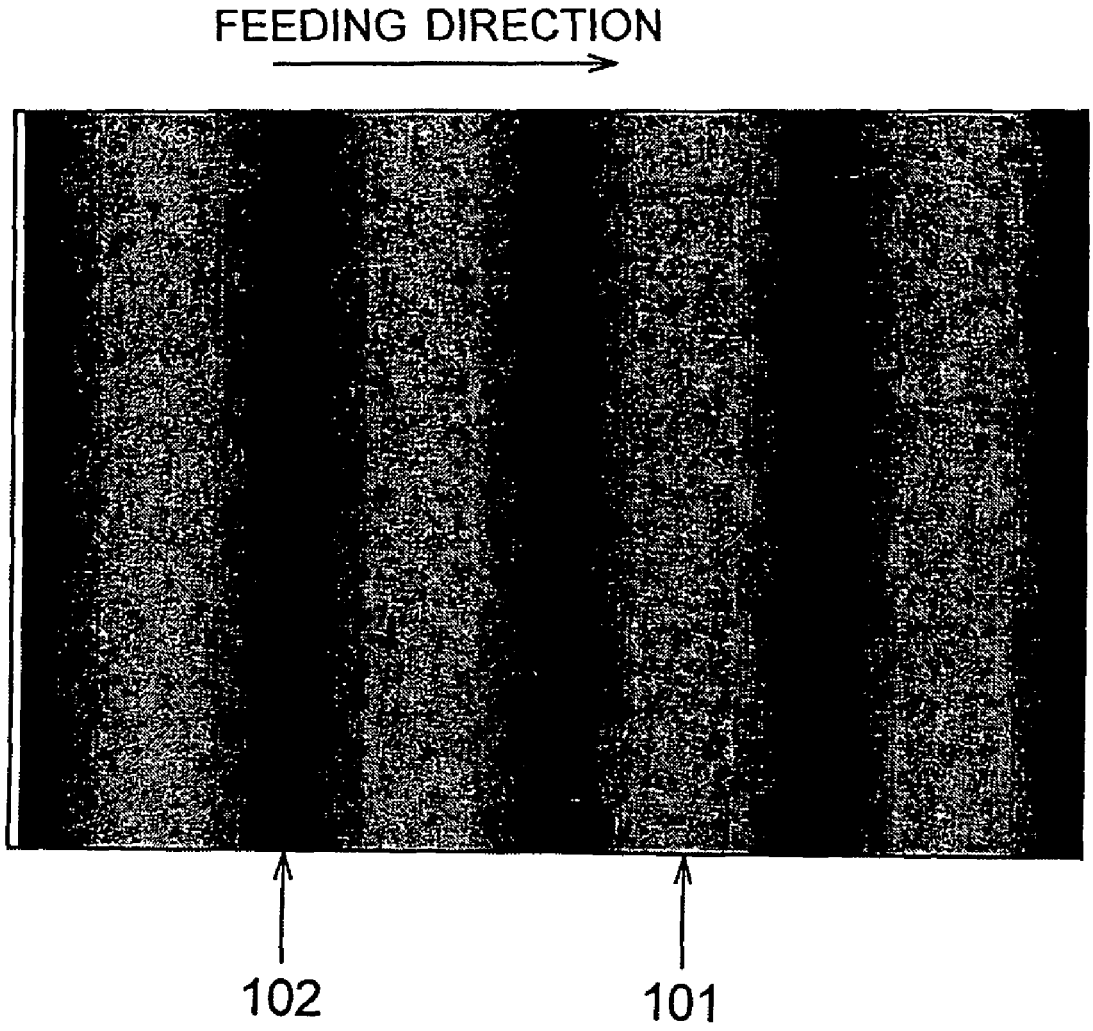
FIG. 1 is a view showing an image in which density irregularity has occurred.

In an image printed by a conventional printer apparatus, the density irregularity occurs, as shown by the areas 101 and 102 in FIG. 1. To verify this, grey is printed on the entire surface of the print sheet 2 as shown in FIG. 1, the gray print is read out with a scanner, and the read out density data is subjected to the Fast Fourier Transform along the feeding direction of the print sheet 2. The obtained data is shown in FIG. 9.

Figure 9:
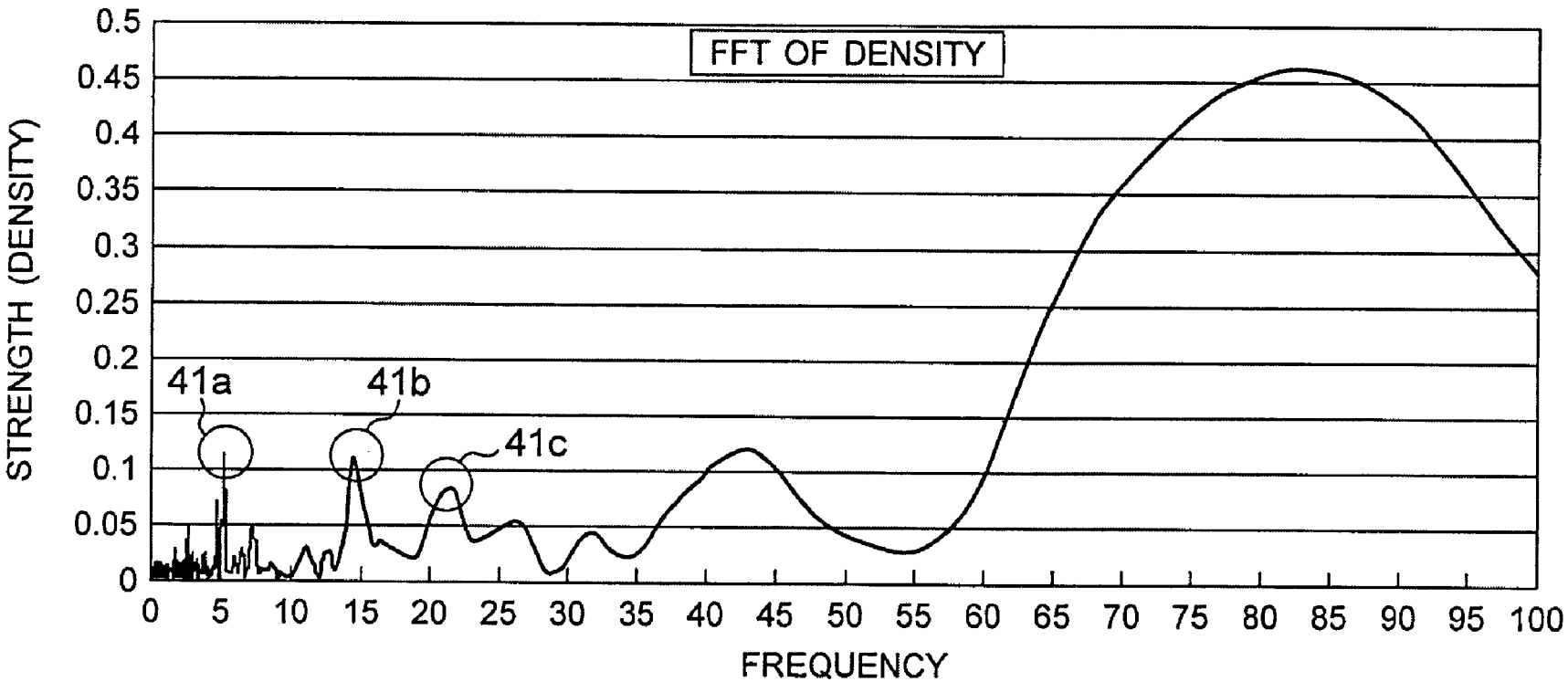
FIG. 9 is a view showing irregularity strength obtained by reading out a gray print with a scanner and applying Fast Fourier Transform to the readout density data.

FIG. 9 shows that the abscissa denotes frequency, and the ordinate denotes spectrum strength (irregularity strength). As can be seen from FIG. 9, peak frequency components 41*a* to 41*c* appear at a plurality of frequency levels, which appears as the density irregularity. The peak frequency component 41*a* corresponds to unsteady component of the rotation of the first pulley 22, the peak frequency component 41*b* corresponds to unsteady component of the rotation of the second pulley 23, and the peak frequency component 41*c* corresponds to unsteady component of the ½ rotation of the capstan 14*d*.

Figure 10:
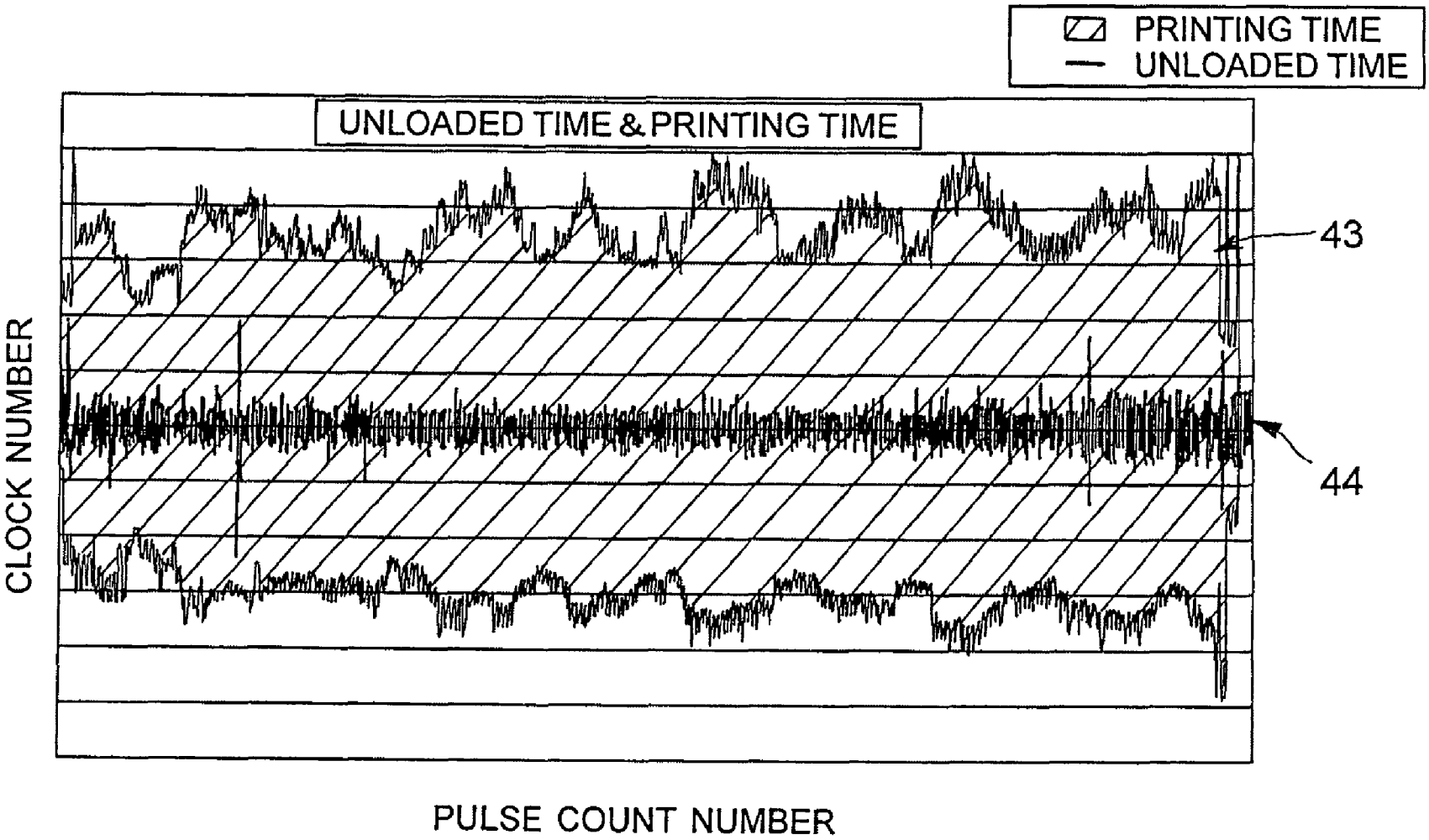
FIG. 10 is a view showing a noise component appearing as a result of extracting the speed fluctuation component of the capstan at printing time and unloaded time.

Fluctuation in the rotational speed of the capstan 14*d* that causes the density irregularity will be verified. Here, the encoder 35 is fitted to the capstan 14*d* like the configuration of the printer apparatus 1, and CPU clock number corresponding to the pulse count number of the output from the encoder 35 is measured. FIG. 10 shows the relationship between the clock number and the pulse count number at printing time where the print sheet 2 is allowed to run and at non-feeding time where the print sheet is not allowed to run, that is, unloaded time. A line 43 denotes the printing time, and a line 44 denotes the unloaded time. However, the output from the encoder 35 contains an enourmous amount of noise components. Further, the noise level greatly differs between the printing time and unloaded time.

Figure 11:
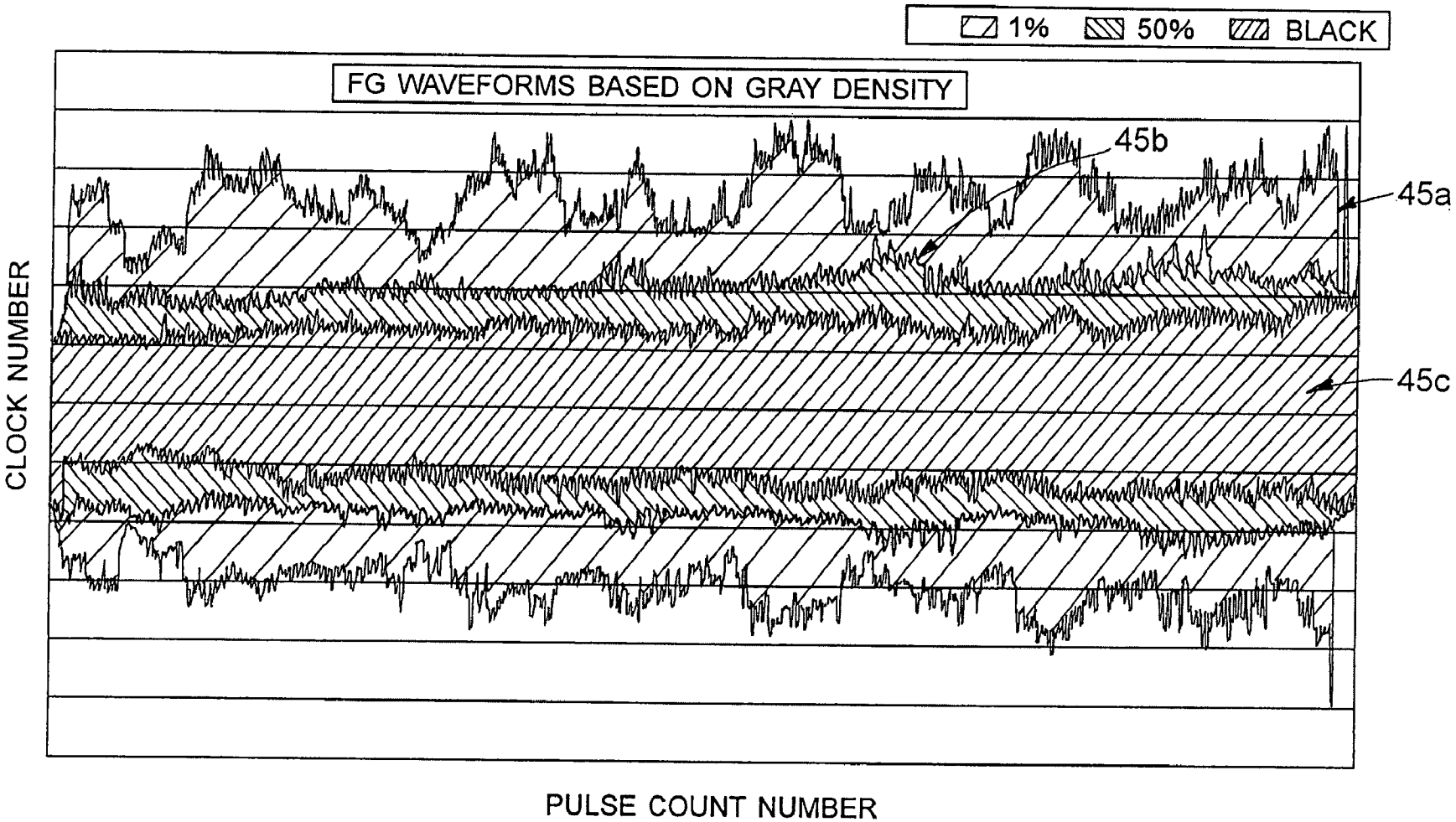
FIG. 11 is a view showing a noise component appearing as a result of extracting the speed fluctuation component of the capstan in the case where images of different densities are printed.

FIG. 11 shows the relationship between the clock number and the pulse count number of the output from the encoder 35 when images of different densities (black 100%, black 50%, black 1%) are printed. A line 45*a* denotes black 1%, a line 45*b* denotes black 50%, and a line 45*c* denotes black 100%. However, also in FIG. 11, the output from the encoder 35 contains an enourmous amount of noise components. Further, the noise level greatly differs depending on the densities.

In the printer apparatus 1 according to the present invention, a pulse signal indicating the rotation number of the capstan 14*d* is input to the controller 42 from the encoder 35, as shown in FIG. 6. The controller 42 removes noise components from the data shown in FIGS. 10 and 11 and thereby extracts only a speed fluctuation component of the capstan 14*d*.

Figure 12:
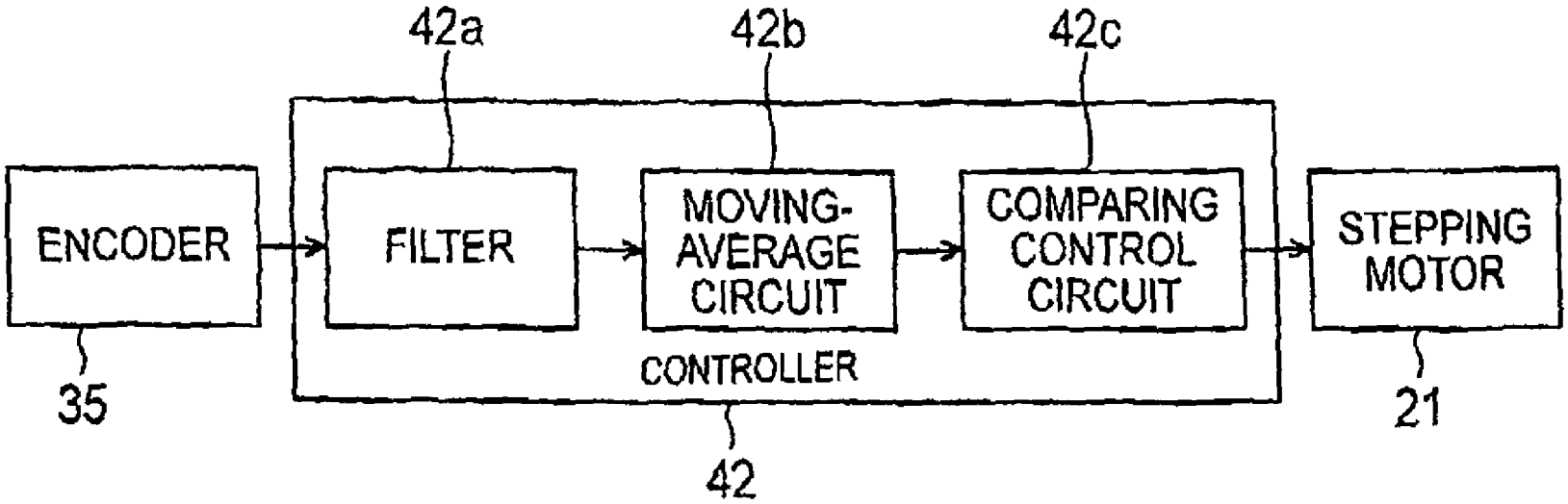
FIG. 12 is a view showing the circuit configuration that removes a noise component included in the output from an encoder.

That is, the controller 42 includes, as shown in FIG. 12, a filter 42*a* to which the pulse signal from the encoder 35 is input, a moving-average circuit 42*b* which performs moving-average of a filtering result, and a comparing control circuit 42*c* which generates a control signal for the stepping motor 21.

The filter 42*a* removes the noise components from the signal as shown in FIGS. 10 and 11 and thereby extracts the speed fluctuation component of the capstan 14*d*. In order to make the rotational speed of the capstan 14*d* constant, the filter 42*a* is required to perform sequential real-time processing. Further, it is preferable to decrease computation amount. Consequently, a dynamic Kalman filter is used as the filter 42*a*. The Kalman filter can sufficiently perform computation within one cycle of the input pulse from the encoder 35.

Figure 13:
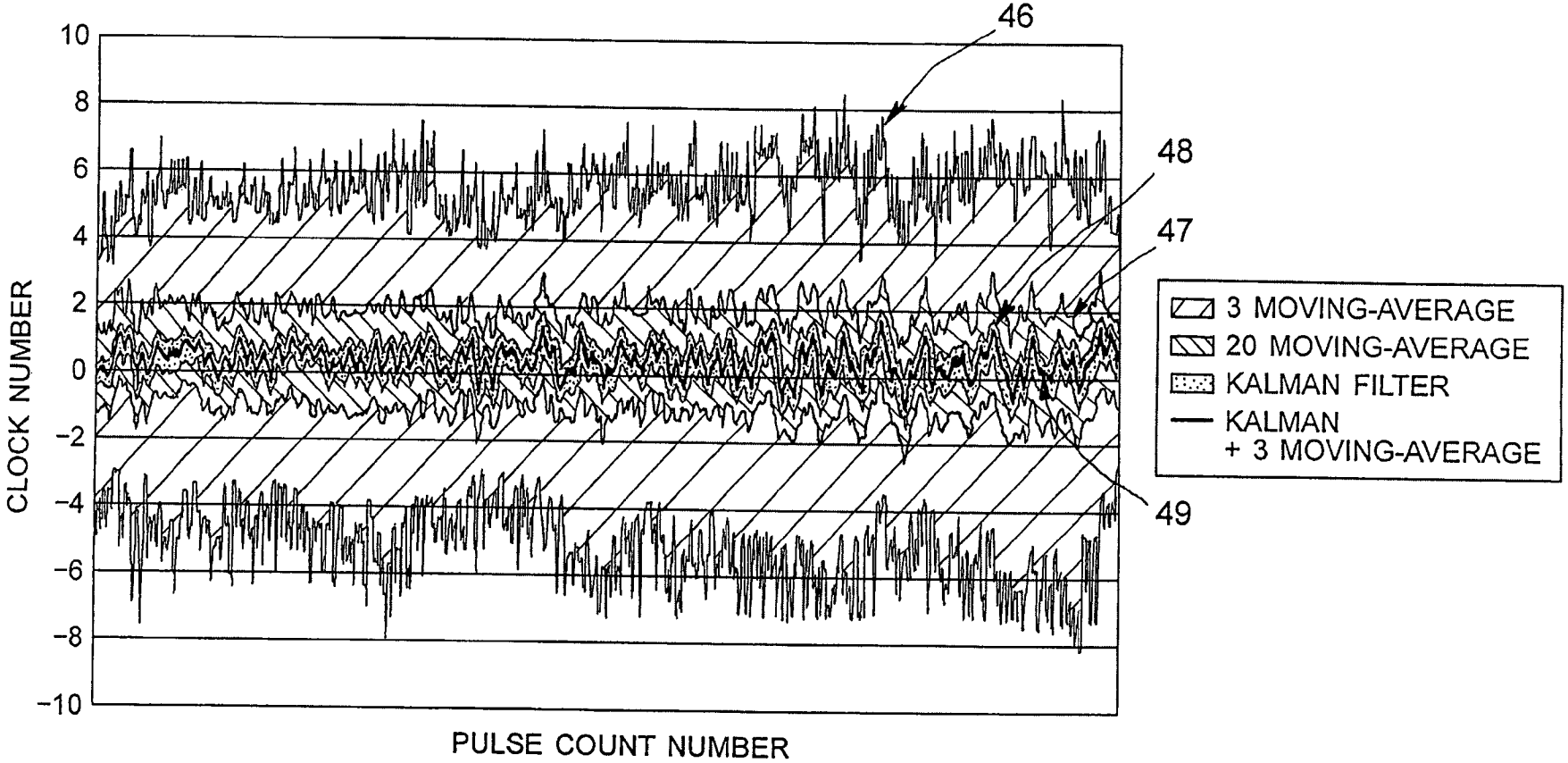
FIG. 13 is a view obtained by comparing noise removal effects of a filter.

FIG. 13 shows the relationship between the CPU clock number and the pulse count number obtained by filtering the output from the encoder 35. In FIG. 13, a line 46 denotes characteristics obtained by 3 moving-average processing, a line 47 denotes characteristics obtained by 20 moving-average processing, a line 48 denotes characteristics obtained by filtering with the Kalman filter, and a line 49 denotes characteristics obtained by Kalman filtering and 3 moving-average processing. As can be seen from FIG. 13, the noise can be removed more effectively with the Kalman filtering (line 48) than with n moving average processing (lines 46 and 47).

As shown by the line 48, the Kalman filter cannot remove the noise component completely. To cope with this, as shown in FIG. 12, the moving-average circuit 42*b* is connected to the rear stage of the filter 42*a* in the controller 42 to perform moving-average processing for the output from the Kalman filter. As shown in FIG. 13, by adding the 3 moving-average processing to the Kalman filtering (line 49), it is possible to remove the noise more effectively than in the case where only Kalman filtering is applied (line 49), thereby extracting the speed fluctuation component of the capstan 14*d*.

The number of moving-average processing is not limited to 3. Further, the moving-average processing may be performed at the front stage of the Kalman filter.

Figure 14A:
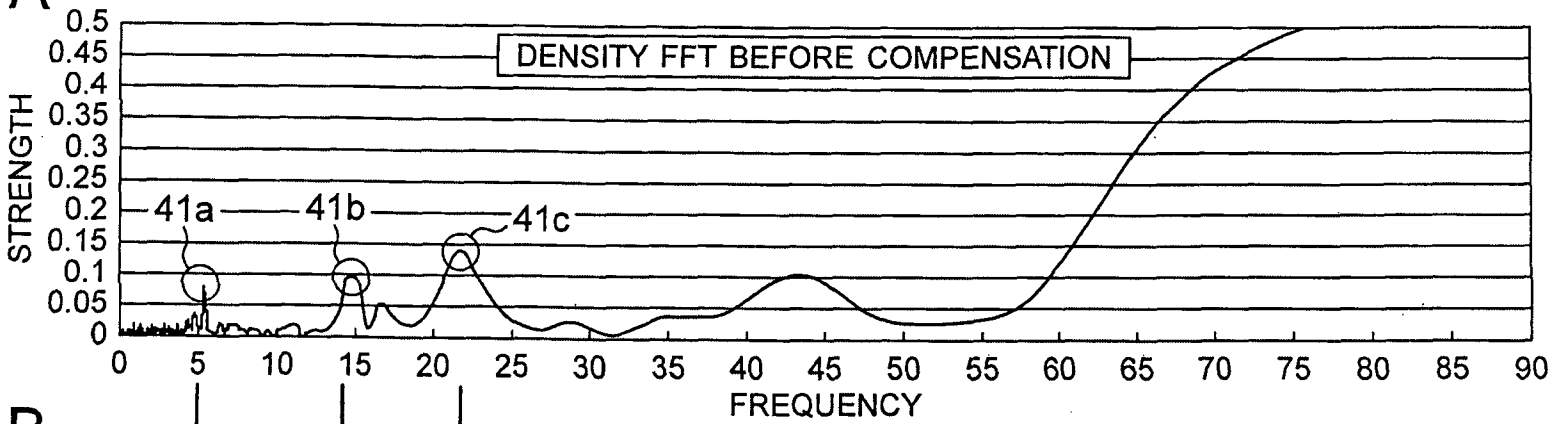
FIGS. 14A and 14B are views showing correlation between the density irregularity in a printed image and speed irregularity of the capstan.
Figure 14B:
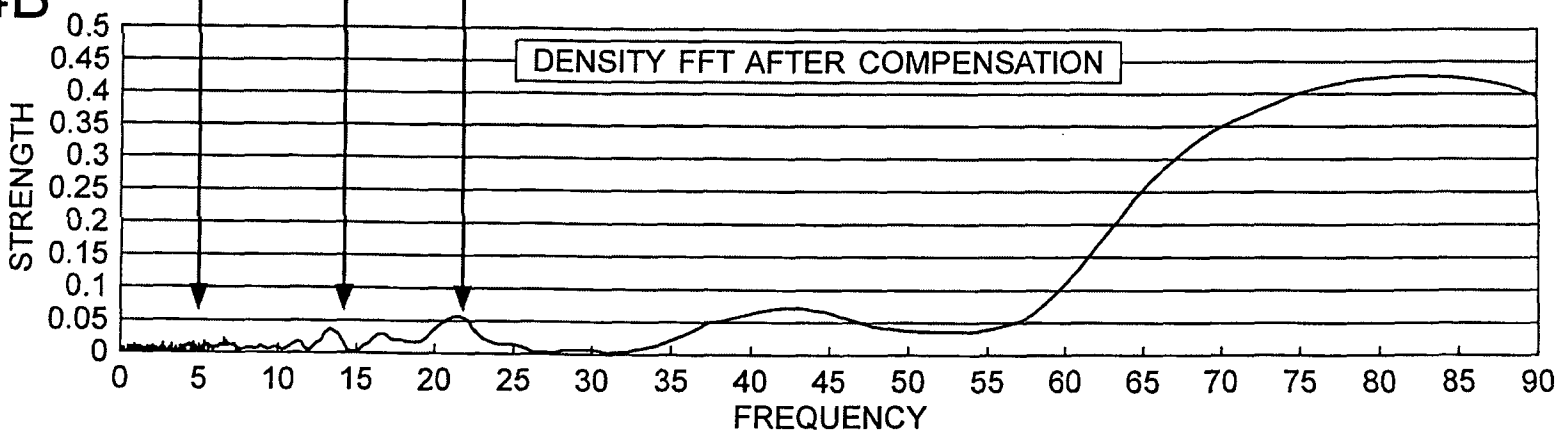

FIG. 14 is a view for comparing the density irregularity in a printed image and speed irregularity of the capstan. More specifically, FIG. 14A is a view showing the relationship between frequency (abscissa) and spectrum strength (irregularity strength) (ordinate) obtained by applying Fast Fourier Transform to the density data same as FIG. 9, and FIG. 14B is a view showing the relationship between frequency (abscissa) and spectrum strength (ordinate) obtained by applying Fast Fourier Transform to clock number which is a speed fluctuation component of the capstan 14*d* in the feeding direction. The comparison between FIG. 14A and FIG. 14B reveals that the peak frequency components 41*a* to 41*c* in FIG. 14A and peak frequency components 40*a* to 40*c* in FIG. 14B appear at the same frequency levels. This indicates that there exists a correlation between the density irregularity and rotational speed of the capstan 14*d*.

The controller 42 determines the peak frequencies 40*a* to 40*c* shown in FIG. 14B as a factor of the density irregularity in a printed image and controls the stepping motor 21 with the comparing control circuit 42*c* so that the peak frequencies 40*a* to 40*c* is reduced or eliminated. The comparing control circuit 42*c* compares a signal output from the moving-average circuit 42*b* and a reference signal stored in a memory.

To be more specific, when the signal (line 49 in FIG. 13) that has been subjected to the filter processing in the filter 42*a* and moving-average circuit 42*b* is greater than the reference signal, that is, when the speed of the capstan 14*d* is less than a reference speed, the comparing control circuit 42*c* makes the cycle of the pulse signal that drives the stepping motor 21 shorter than a reference pulse signal to increase the rotation number of the stepping motor 21, thereby increasing the rotational speed of the capstan 14*d*.

When the signal (line 49 in FIG. 13) that has been subjected to the filter processing in the filter 42*a* and moving-average circuit 42*b* is smaller than the reference signal, that is, when the speed of the capstan 14*d* is greater than a reference speed, the comparing control circuit 42*c* makes the cycle of the pulse signal that drives the stepping motor 21 longer than a reference pulse signal to reduce the rotation number of the stepping motor 21, thereby reducing the rotational speed of the capstan 14*d*.

Figure 15A:
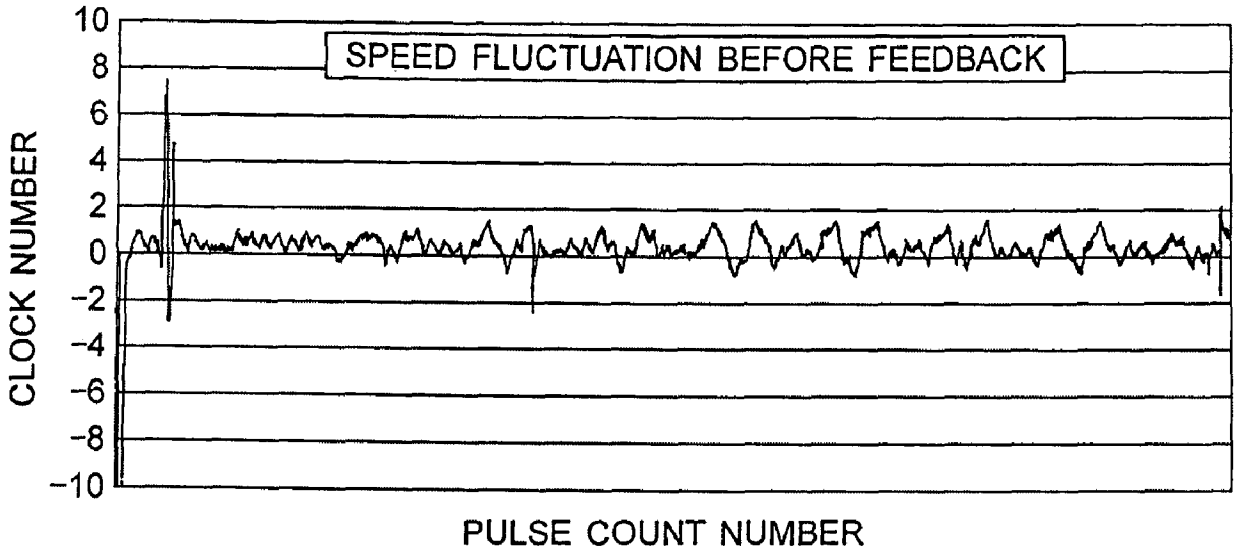
FIGS. 15A and 15B are views showing clock number based on pulse number.
Figure 15B:
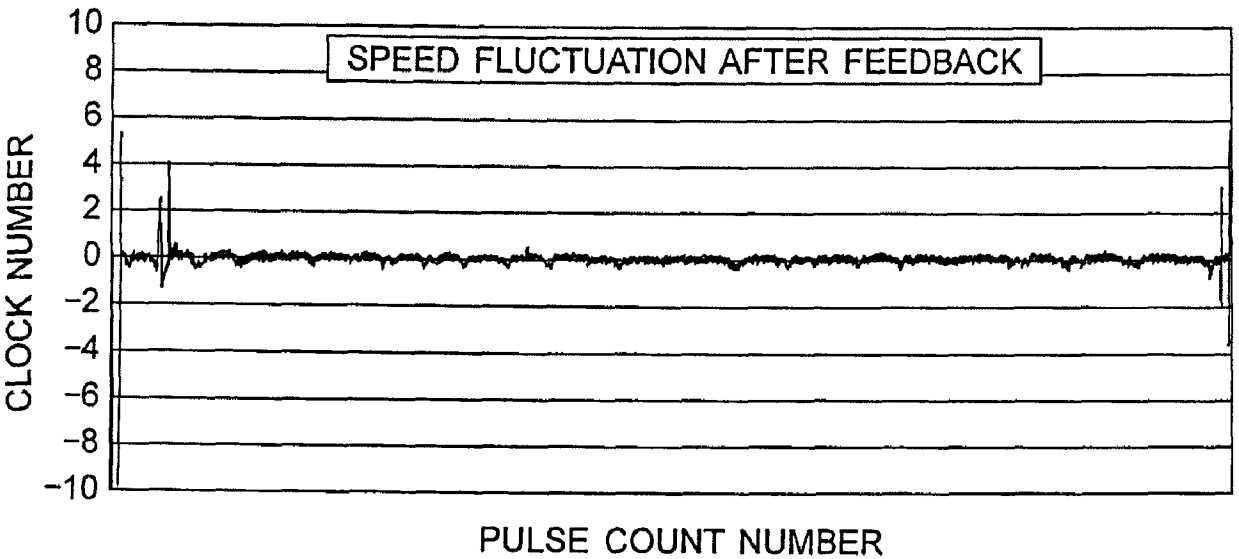

FIG. 15 shows a result obtained when the controller 42 performs the above control. In FIG. 15, FIG. 15A shows a result obtained before feedback control of the controller 42, and FIG. 15B shows a result obtained after feedback control of the controller 42. As can be seen from the comparison between FIGS. 15A and 15B, the fluctuation of the CPU clock becomes smaller in FIG. 15B (after feedback control) than in FIG. 15A, that is, the fluctuation of the CPU clock is substantially eliminated to make the rotational speed of the capstan 14*d* nearly constant.

Figure 16A:
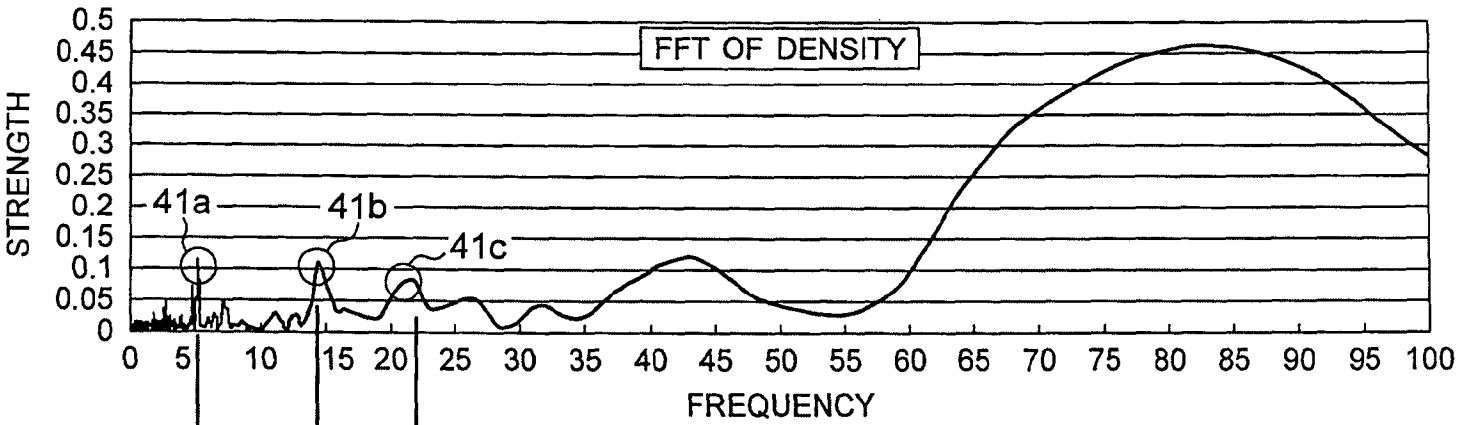
FIGS. 16A and 16B are views showing irregularity strength obtained by reading out a gray print with a scanner and applying Fast Fourier Transform to the readout density data.
Figure 16B:
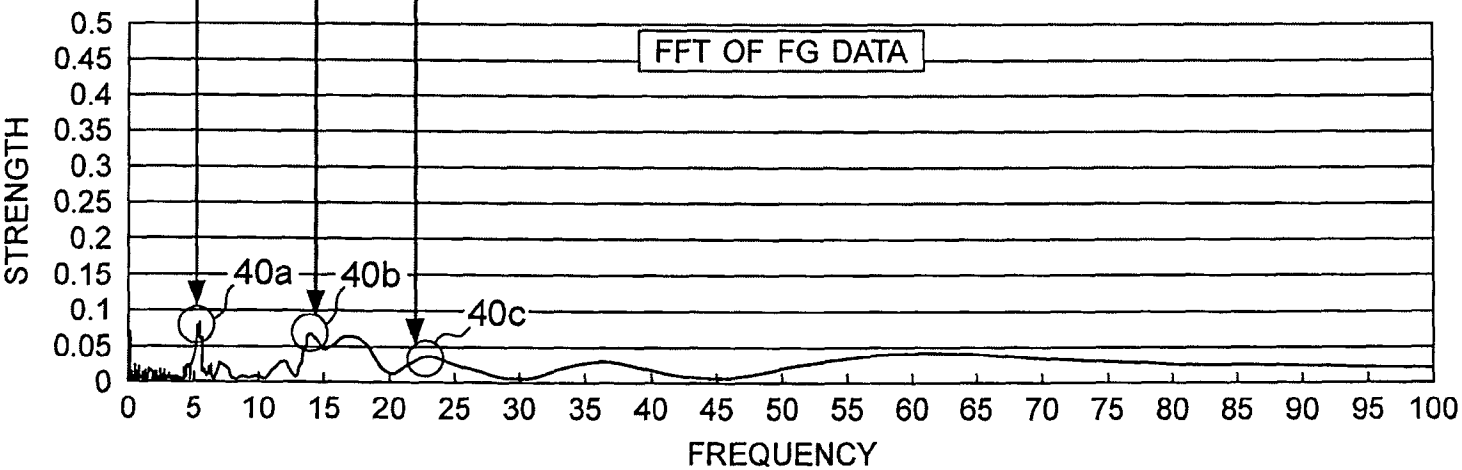

As in the case of FIG. 9, grey is printed on the entire surface of the print sheet 2, the gray print is read out with a scanner, and the read out density data is subjected to the Fast Fourier Transform (FFT) along the feeding direction of the print sheet 2. The obtained density data is shown in FIG. 16. In FIG. 16, FIG. 16A shows a result obtained before feedback control, and FIG. 16B shows a result obtained after feedback control. As can be seen from the comparison between FIGS. 16A and 16B, the entire curve including the peak frequency components 41*a* to 41*c* becomes flat. This indicates the density irregularity has been reduced in a printed image.

In the printer apparatus 1 having the configuration as described above, the controller 42 extracts the rotational speed fluctuation component of the capstan 14*d* and controls the stepping motor 21 so that the speed fluctuation component is reduced or eliminated, thereby making the rotational speed of the capstan 14*d* constant while allowing for a mechanical error of the drive transmission mechanism 20*a* and the like. Therefore, in a printed image, the density irregularity caused due to the fluctuation of the feeding speed of the print sheet 2 can be reduced or eliminated. Further, it is possible to make it easier to design and assemble the drive transmission mechanism 20*a*.

In the encoder disc 36 provided for the capstan 14*d*, the encoder 35 can output a plurality of pulses while the print head 14*a* prints one line. Further, the Kalman filter is used as the filter 42*a*, so that the controller 42 can extract the fluctuation component of the rotational speed of the capstan 14*d* in real time. Therefore, the controller 42 has excellent response characteristics to the speed fluctuation and thereby can control the rotational speed of the capstan 14*d* in real time.

The above control performed by the controller 42 can be realized by hardware as well as by software. In the case where software is used, the above control can be realized by storing software to which the present invention is applied in a memory such as a hard disc or semiconductor memory and by performing computation with a CPU.

The print sheet 2 is fed by the capstan 14*d* in the printer apparatus 1 described above. In the case of using a printer apparatus in which the platen roller 14*c* is rotated in printing time to feed the print sheet 2, the encoder 35 may be fitted to the drive shaft of the platen roller 14*c*. In this configuration, the controller 42 extracts the rotational speed fluctuation component of the platen roller 14*c* to thereby control the stepping motor 21 so that the platen roller 14*c* is rotated at a constant speed. By this, it is possible to obtain the same effect as that in the case of the printer apparatus 1.

Although the heat-sensitive layer 2*b* is formed on the print sheet 2 and the print head 14*a* prints an image on the heat-sensitive layer 2*b* in the above example, the present invention is also applied to a thermal printer apparatus in which a print head allows ink of an ink ribbon to sublime to thereby thermally transfer an image on a print sheet, or an inkjet printer that discharges ink to print an image on a print sheet.

It should be understood by those skilled in the art that various modifications, combinations, sub-combinations and alternations may occur depending on design requirements and other factors insofar as they are within the scope of the appended claims or the equivalents thereof.

What is claimed is:

1. A printing media feeding apparatus comprising:

feeding means that includes a motor, a drive transmission mechanism which transmits a driving force of the motor, and a drive shaft to which the driving force is transmitted by the drive transmission mechanism, the drive shaft being rotated to feed or transport a printing media;

detection means that has a portion which is mechanically connected to the drive shaft and detects the rotational speed of the drive shaft, wherein the detection means generates a plurality of pulse signals while the drive shaft is rotated in a feed direction and at least two of the pulse signals corresponding to rotation of the drive shaft in the feed direction while one line of image information is being printed, the pulse signals providing an indication of rotational speed; and control means for controlling the motor, the control means controlling the motor based on an input from the detection means so that the rotational speed of the drive shaft becomes substantially constant, and as a result, the speed of the printing media being fed by the feeding means also becomes substantially constant, wherein the control means further includes a moving-average circuit that directly receives an output of a Kalman filter and a comparing control circuit receives an output from the moving-average circuit, the comparing control circuit compares the output from the moving-average circuit with reference data stored in a memory and provides a control output for controlling the motor based on a comparison result, and further wherein the comparing control circuit determines a rotational speed fluctuation component and controls the stepping motor to substantially eliminate or reduce the rotational speed fluctuation component.

2. The printing media feeding apparatus according to claim 1, wherein the drive shaft is a capstan.

3. A printing apparatus comprising:

a print head that prints visual data on the printing media;

feeding means that includes a motor, a drive transmission mechanism which transmits a driving force of the motor, and a drive shaft to which the driving force is transmitted by the drive transmission mechanism, the drive shaft being rotated to feed or transport a printing media;

detection means that has a portion which is mechanically connected to the drive shaft and detects the rotational speed of the drive shaft, wherein the detection means generates a plurality of pulse signals while the drive shaft is rotated in a feed direction and at least two of the pulse signals corresponding to rotation of the drive shaft in the feed direction while one line of image information is being printed, the pulse signals providing an indication of rotational speed; and control means for controlling the motor, the control means controlling the motor based on an input from the detection means so that the rotational speed of the drive shaft becomes substantially constant, and as a result, the speed of the printing media being fed by the feeding means also because substantially constant, wherein the control means further includes a moving-average circuit that directly receives an output of a Kalman filter and a comparing control circuit receives an output from the moving-average circuit, the comparing control circuit compares the output from the moving-average circuit with reference data stored in a memory and provides a control output for controlling the motor based on a comparison result, and further wherein the comparing control circuit determines a rotational speed fluctuation component and controls the stepping motor to substantially eliminate or reduce the rotational speed fluctuation component.

4. A printing media feeding speed control method that rotates a drive shaft through a drive transmission mechanism transmitting a driving force of a motor to feed printing media, comprising:

detecting the rotational speed of the drive shaft via a detection mechanism having at least a portion of which attached to the drive shaft, wherein the detection mechanism generates a plurality of pulse signals while the drive shaft is rotated in a feed direction and at least two of the pulse signals corresponding to rotation of the drive shaft in the feed direction while one line of image information is being printed, the pulse signals providing an indication of rotational speed; and controlling the rotation number of the motor based on the detected rotational speed so that the rotational speed of the drive shaft becomes substantially constant, and as a result, the speed of the printing media being driven by the drive shaft also becomes substantially constant, wherein the control means further includes a moving-average circuit that directly receives an output of a Kalman filter and a comparing control circuit receives an output from the moving-average circuit, the comparing control circuit compares the output from the moving-average circuit with reference data stored in a memory and provides a control output for controlling the motor based on a comparison result, and further wherein the comparing control circuit determines a rotational speed fluctuation component and controls the stepping motor to substantially eliminate or reduce the rotational speed fluctuation component.

5. The printing media feeding speed control method according to claim 4, further comprising a step of performing moving-average processing directly or indirectly on an output of a Kalman filter.

6. The printing media feeding speed control method according to claim 4, wherein said drive shaft is positioned so as to directly contact the printing media during feeding and to cause the printing media to move.

7. A non-transitory computer readable medium containing a computer program used for a printing media feeding speed control, the computer program when running controlling rotation of a drive shaft through a drive transmission mechanism transmitting a driving force of a motor to feed printing paper, the computer program controlling:

a memory, wherein the memory is an electronic or magnetic memory;

detecting the rotational speed of the drive shaft via a detection mechanism having at least a portion of which attached to the drive shaft, wherein the detection mechanism generates a plurality of pulse signals while the drive shaft is rotated in a feed direction and at least two of the pulse signals corresponding to rotation of the drive shaft in the feed direction while one line of image information is being printed, the pulse signals providing an indication of rotational speed; and controlling the rotation of the motor based on the detected rotational speed so that the rotational speed of the drive shaft becomes substantially constant, and as a result, the speed of the printing media being driven by the drive shaft also becomes substantially constant, wherein the computer program further includes a control means including a moving-average circuit that directly receives an output of a Kalman filter and a comparing control circuit receives an output from the moving-average circuit, the comparing control circuit compares the output from the moving-average circuit with reference data stored in the memory and provides a control output for controlling the motor based on a comparison result and further wherein the comparing control circuit determines a rotational speed fluctuation component and controls the motor to substantially eliminate or reduce the rotational speed fluctuation component.

8. A printing media feeding apparatus comprising:

a feeding section that includes a motor, a drive transmission mechanism which transmits a driving force of the motor, and a drive shaft to which the driving force is transmitted by the drive transmission mechanism, the drive shaft being rotated to feed or transport a printing media;

a detection section that has a portion which is mechanically connected to the drive shaft and detects the rotational speed of the drive shaft, wherein the detection section generates a plurality of pulse signals while the drive shaft is rotated in a feed direction and at least two of the pulse signals corresponding to rotation of the drive shaft in the feed direction while one line of image information is being printed, the pulse signals providing an indication of rotational speed; and a controller that controls the motor, the controller controlling the motor based on an input from the detection section so that the rotational speed of the drive shaft becomes substantially constant, and as a result, the speed of the printing media being fed by the feeding means also becomes substantially constant, wherein said controlling step includes the step of applying a signal from the detection mechanism in said detecting step to a Kalman filter that extracts a rotational speed fluctuation component of the drive shaft, wherein the control means further includes a moving-average circuit that directly receives an output of a Kalman filter and a comparing control circuit receives an output from the moving-average circuit, the comparing control circuit compares the output from the moving-average circuit with reference data stored in a memory and provides a control output for controlling the motor based on a comparison result, and further wherein the comparing control circuit determines a rotational speed fluctuation component and controls the stepping motor to substantially eliminate or reduce the rotational speed fluctuation component.

9. The printing media feeding apparatus according to claim 8, wherein said drive shaft is positioned so as to directly contact the printing media during feeding and to cause the printing media to move.

10. The printing media feeding apparatus according to claim 8, wherein said drive shaft is a platen roller.

11. A printing apparatus comprising:

a print head that prints visual data on a printing media;

a feeding section that includes a motor, a drive transmission mechanism which transmits a driving force of the motor, and a drive shaft to which the driving force is transmitted by the drive transmission mechanism, the drive shaft being rotated to feed or transport the printing media;

a detection section has a portion which is mechanically connected to the drive shaft and detects the rotational speed of the drive shaft, wherein the detection section generates a plurality of pulse signals while the drive shaft is rotated in a feed direction and at least two of the pulse signals corresponding to rotation of the drive shaft in the feed direction while one line of image information is being printed, the pulse signals providing an indication of rotational speed; and a controller that controls the motor, the controller controlling the motor based on an input from the detection section so that the rotational speed of the drive shaft becomes substantially constant, and as a result, the speed of the printing media being fed by the feeding means also because substantially constant, wherein the control means further includes a moving-average circuit that directly receives an output of a Kalman filter and a comparing control circuit receives an output from the moving-average circuit, the comparing control circuit compares the output from the moving-average circuit with reference data stored in a memory and provides a control output for controlling the motor based on a comparison result, and further wherein the comparing control circuit determines a rotational speed fluctuation component and controls the stepping motor to substantially eliminate or reduce the rotational speed fluctuation component.

12. The printing apparatus according to claim 11, wherein said drive shaft is positioned so as to directly contact the printing media during feeding and to cause the printing media to move.

13. The printing apparatus according to claim 11, wherein said drive shaft is a platen roller.

* * * * *